US006079392A

United States Patent [19]

Matsuda

[11] Patent Number: 6,079,392

[45] **Date of Patent: *Jun. 27, 2000**

[54] FUEL INJECTION DEVICE FOR MODEL ENGINE

[75] Inventor: Norio Matsuda, Mobara, Japan

[73] Assignee: Futaba Denshi Kogyo K.K., Mobara, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/873,737

[22] Filed: Jun. 12, 1997

[30] Foreign Application Priority Data

Jun. 19, 1996 [JP] Japan ..... 8-157953

[51] Int. Cl.[7] ..... F02M 41/00

[52] U.S. Cl. ..... 123/458; 123/531

[58] Field of Search ..... 123/531, 533, 123/458, 446; 251/129.15, 129.19

[56] References Cited

U.S. PATENT DOCUMENTS

| | | | |
|---|---|---|---|
| 4,754,739 | 7/1988 | Czwienczek | 123/533 |
| 4,756,293 | 7/1988 | Suzuki | 123/533 |
| 4,782,809 | 11/1988 | Kotowski | 123/531 |
| 4,841,942 | 6/1989 | McKay | 123/533 |
| 5,113,829 | 5/1992 | Motoyama | 123/531 |
| 5,488,933 | 2/1996 | Pham | 123/531 |

*Primary Examiner*—Carl S. Miller

*Attorney, Agent, or Firm*—Oblon, Spivak, McClelland, Maier & Neustadt, P.C.

[57] ABSTRACT

A fuel injection device for a model engine capable of injecting fuel directly into a combustion chamber of the engine, to thereby insure stable feeding of fuel even under severe operational conditions. A check valve is arranged in a fuel injection passage or port to prevent backflow of fuel. Such construction permits the fuel injection device to be mounted directly on a cylinder of the engine to inject fuel directly into a combustion chamber of the engine, unlike the prior art. Also, in the present invention, pressurized air held in an air holding space may be injected together with fuel only during fuel injection, resulting in fuel being injected in the form of a fine mist-like shape.

3 Claims, 6 Drawing Sheets

FUEL INJECTION DEVICE FOR MODEL ENGINE

BACKGROUND OF THE INVENTION

This invention relates to a fuel injection device, and more particularly to a fuel injection device of the electronic control type incorporated in an engine for a model (hereinafter referred to as "model engine").

A two-cycle or four-cycle glow engine which has been conventionally known to be a model engine includes a carburetor as indicated at reference numeral 100 in FIG. 6.

More particularly, the carburetor 100 includes a housing 101, in which a valve body 102 formed into a substantially cylindrical shape is arranged so as to be rotatable about an axis thereof. The housing 101 has upper and lower pipings 101*a* and 101*b* connected thereto so as to vertically extend therefrom, so that air is fed thereto through the upper piping 101*a*. Also, the valve body 102 is provided with a passage 102*a* in a manner to extend therethrough, which is arranged so as to communicate with the pipings 101*a* and 101*b* depending on a degree of opening of the valve body 102. The valve 102 has an operation arm 103 connected to a portion thereof projecting from one end of the housing 101. The operation arm 103 has an operation section of a servo mechanism (not shown) connected thereto in such a manner that the servo mechanism pivotally moves or rotates the vale body 102 in the housing. The valve 102 is provided with a needle 104 through screws, so that rotation of the needle 104 permits the amount of projection of the needle 104 into the valve body 102 to be adjusted.

The housing 101 has a needle valve 105 for fuel control or adjustment incorporated in the other end thereof. The needle valve 105 includes a pipe section 106 and a needle 107 arranged in the pipe section 106. The needle 107 is screwed to the pipe section 106 and provided on a proximal portion thereof with a lug 108, so that rotational operation of the lug 108 permits the needle 107 to be moved in an axial direction thereof in the pipe section 106, to thereby adjust a degree of opening of a distal end of the pipe section 106. The needle 104 in the valve body 102 is so arranged that a distal end thereof faces an opening formed at the distal end of the pipe section 106.

In the conventional carburetor 100 thus constructed, fuel fed to the needle valve 105 is injected into the valve 102 through a gap between the distal end of the pipe section 106 and the needle 107, to thereby be mixed with air fed into the valve 102 to prepare an air-fuel mixture, which is then fed to an engine. Operation of the lug of the needle valve 107 permits a flow rate of fuel to be adjusted, resulting in a flow rate of fuel or an air-fuel ratio sufficient to provide a maximum rotational speed of the engine being previously set. Operation of the valve body 102 by a servo mechanism adjusts the amount of air flowed into the valve body 102, so that the amount of fuel fed to the engine may be adjusted.

The conventional carburetor 100 fails to feed fuel in an amount corresponding to a large amount of air sucked into the valve body, to thereby unbalance an air-fuel ratio, when the engine is to be rapidly increased in rotational speed from a low level during idling or the like to a high level. Thus, the conventional carburetor 100 fails to smoothly or rapidly increase the engine speed and, in the worst case, stops the engine. Also, the carburetor fails to exhibit satisfactory responsibility, resulting in much time being required to change the engine speed from a lower level to a high level or from a high level to a low level. Also, when a model engine is mounted on, for example, a radio-controlled model airplane, centrifugal force generated during flight of the model airplane affects fuel fed to the carburetor, leading to a failure in appropriate feeding of fuel to the carburetor, resulting in satisfactory operation of the engine being impeded.

In view of such problems of the conventional carburetor, the inventors proposed a fuel injection device applied to a model engine. The fuel injection device proposed is constructed so as to inject, into a combustion chamber of a model engine, fuel electronically controlled and pressurized under a pressure corresponding to a pressure generated in a crank case of the model engine. The fuel injection device was expected to stably feed fuel to a model engine exposed to severe operational conditions while satisfactorily balancing an air-fuel ratio and ensuring good responsibility.

Unfortunately, it was found that the fuel injection device proposed by the inventors encounters some problems to be solved. More particularly, the fuel injection device is subject to restriction on a mounting position through which the device is mounted on the model engine. Also, it fails to be mounted directly in the combustion chamber of the engine to inject fuel directly into the combustion chamber. This is due to the fact that a pressure generated during compression and explosion strokes of the engine causes backflow of fuel to the fuel injection device and/or leads to a failure in sufficient compression of fuel in the fuel injection device.

Thus, the fuel injection device fails to pressurize fuel under a pressure generated in the crank case and therefore requires an additional fuel pressurizing unit specially designed, resulting in being increased in cost to a level excessive to or unsuitable for the model engine.

Also, in order to ensure increased combustion and output of the model engine by excessive feeding of fuel to the engine, the fuel injection device requires an excessive-feed tank and a pressurizing mechanism, to thereby be likewise increased in cost to a level excessive to the model engine.

SUMMARY OF THE INVENTION

The present invention has been made in view of the foregoing disadvantage of the prior art.

Accordingly, it is an object of the present invention to provide a fuel injection device which is capable of stably feeding fuel to a model engine exposed to severe operational conditions such as a model engine mounted on a radio-controlled model airplane carrying out acrobatics such as looping and the like.

It is another object of the present invention to provide a fuel injection device for a model engine which is capable of ensuring a balanced air-fuel ratio.

It is a further object of the present invention to provide a fuel injection device for a model engine which is capable of permitting the model engine to exhibit increased performance.

It is still another object of the present invention to provide a fuel injection device for a model engine which is capable of effectively preventing backflow of fuel injected.

It is yet another object of the present invention to provide a fuel injection device for a model engine which is capable of being mounted in the model engine without being subject to restriction on a mounting position.

In accordance with the present invention, a fuel injection device for a model engine is provided. The fuel injection device includes a fuel injection port through which fuel is injected into a combustion chamber of the model engine. The fuel injection port is provided with a backflow preventing means for preventing backflow of fuel.

In a preferred embodiment of the present invention, the backflow preventing means is constituted by a check valve including a valve body abutted against an outside of the fuel injection port and an urging means for pressedly contacting the valve body with the outside of the fuel injection port.

Also, in accordance with the present invention, a fuel injection device for a model engine is provided. The fuel injection device includes a housing, a fuel holding space defined in the housing, a fuel feed passage through which fuel is fed to the fuel holding space, a fuel injection port which is provided at the housing so as to communicate with the fuel holding space and through which fuel is injected into a combustion chamber of the model engine, a solenoid coil arranged in the housing, a core arranged in the solenoid coil, a valve body arranged in the housing and magnetically attaching to the core due to energizing of the solenoid coil to open the fuel injection port, an urging means for urging the valve body in a direction of closing of the fuel injection port, and a check valve arranged at the fuel injection port to prevent backflow of fuel from the fuel injection port to an interior of the housing.

In a preferred embodiment of the present invention, the fuel injection device further includes an air holding space defined in the housing to hold therein pressurized air fed from an exterior of the housing, an air pipe fixed on the valve body to permit the air holding space and fuel injection port to communicate with each other, and an air control valve arranged so as to interrupt communication between the air holding space and the air pipe while the valve body keeps the fuel injection port closed and maintain the communication while the valve body keeps the fuel injection port open.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a fuel injection device for a model engine according to the present invention will be described hereinafter with reference to FIGS. 1 to 5.

Figure 1:
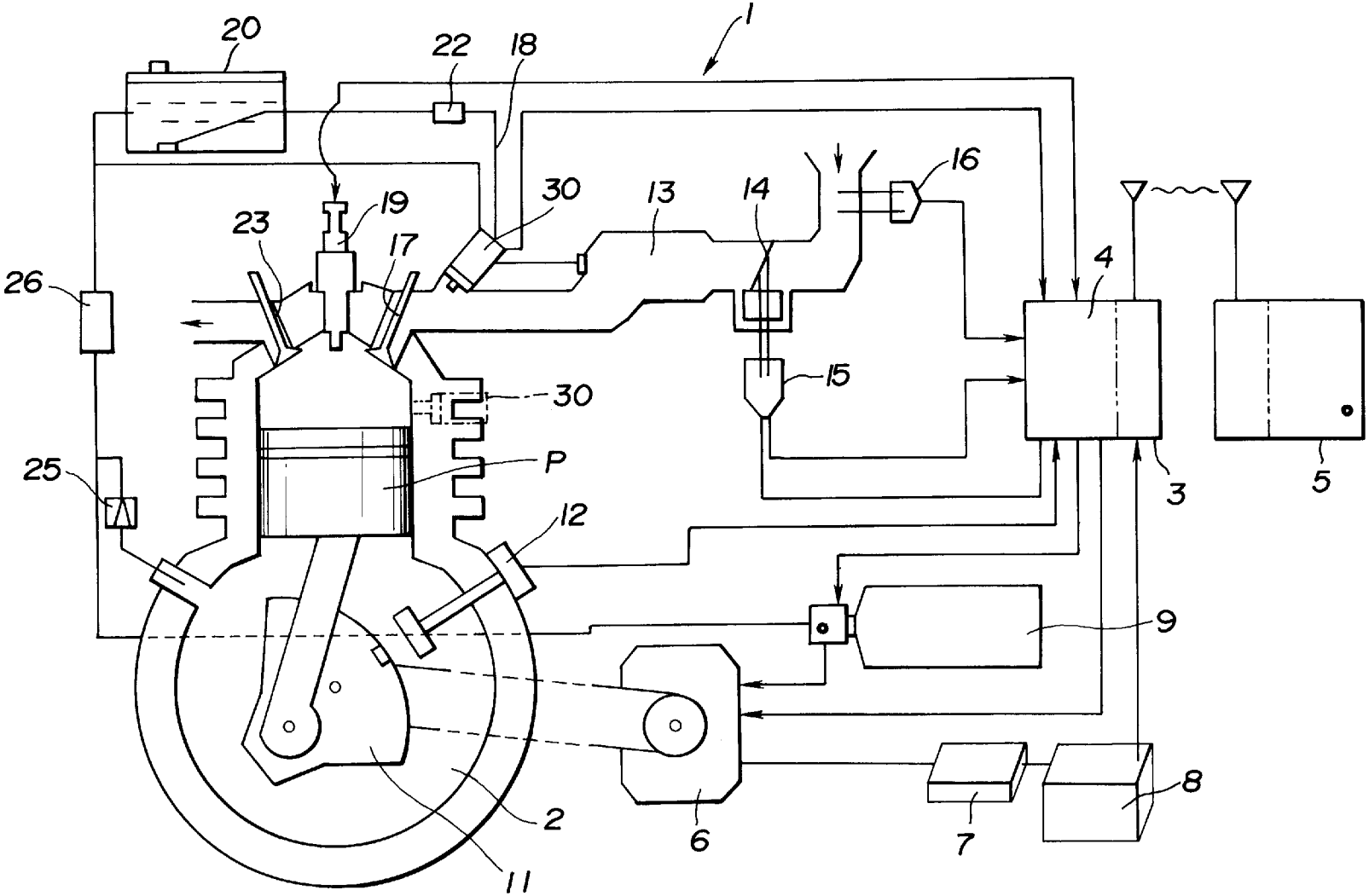
FIG. 1 is a schematic view showing an example of a model engine to which an embodiment of a fuel injection device according to the present invention may be applied.
Figure 2:
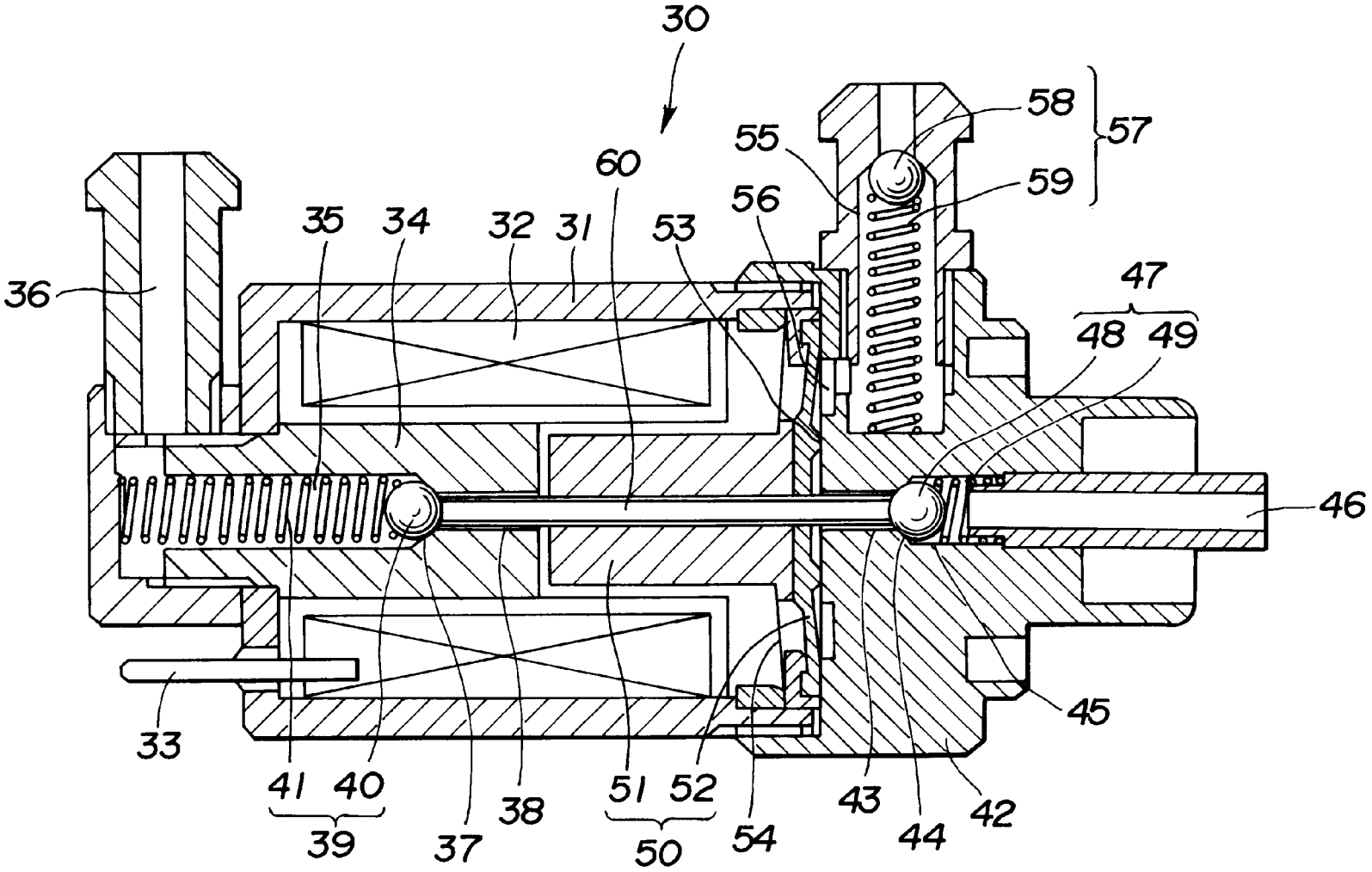
FIG. 2 is a sectional view showing an embodiment of a fuel injection device for a model engine according to the present invention.
Figure 3:
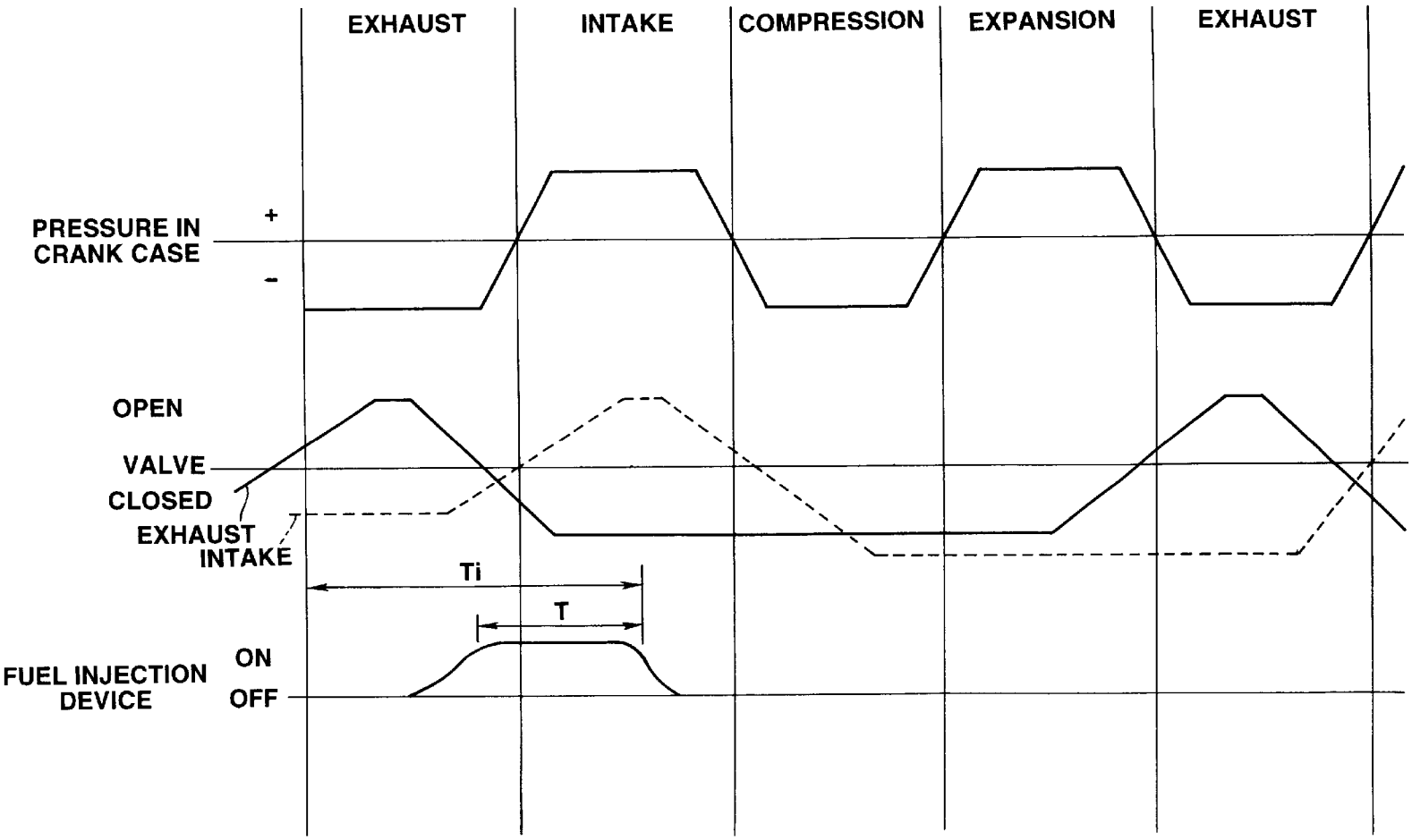
FIG. 3 is a timing chart showing a timing of actuation of a model engine having the fuel injection device of FIG. 2 incorporated therein, that of a variation in pressure in a crank case, that of actuation of a valve and that of actuation of the fuel injection device of FIG. 2.

Referring first to FIGS. 1 to 3, a first embodiment of a fuel injection device for a model engine according to the present invention is illustrated. A fuel injection device of the illustrated embodiment is adapted to be applied to a model engine electrically controlled. A model engine having the fuel injection device of the illustrated embodiment incorporated is generally designated at reference numeral 1 in FIG. 1 and mounted on a model airplane by way of example. The engine 1 is of the four-cycle type and adapted to use methyl alcohol containing additives such as lubricating oil, nitromethane and the like as fuel therefor. The engine 1 includes a combustion chamber of 1 to 30 cc in volume and a crank case 2, in which a pressure is generated during driving of the engine. The pressure in the crank case 2 is a pulsating pressure of which a positive pressure has a peak value of about 20 kPa to 100 kPa and a negative pressure has a peak value of −20 kPa to −100 kPa. The positive and negative pressures are based on an average pressure in the crank case 2.

The engine 1 is controlled by a control section 4 of a receiver 3 mounted on a radio-controlled model airplane. Operation of a transmitter 5 by an operator permits the receiver 3 to receive a radio wave from the transmitter 5, so that it controls various sections of the model airplane including the engine 1.

The engine 1 shown in FIG. 1 is started by a starter 6. The starter 6 is driven by an electric power fed from a battery 8 through a rectifier 7 thereto, pressurized air fed from a pressurizing means 9 thereto or the like.

The crank case 2 is provided with a rotational position sensor 12 acting as a stroke detection means for detecting a position of a crank 11 rotating. The sensor 12 detects a drive cycle of the engine, to thereby determine a timing of fuel injection. An output signal of the rotational position sensor 12 is fed to the control section 4 of the radio-controlled receiver 3 to control the engine 1.

The engine 1 also includes an intake manifold 13, which is provided with a throttle valve 14 for controlling the amount of intake air. The throttle valve 14 has a degree of opening controlled by a drive means 15. The drive means 15 is controlled by the control section 4 of the radio-controlled receiver 3. The intake manifold 13 has an air intake port provided with an intake air quantity/temperature sensor 16 for detecting the amount of intake air and a temperature thereof. A signal outputted from the sensor 16 is inputted to the control section 4 of the radio-controlled receiver 3 to control the engine 1.

The intake manifold 13 also includes an intake valve 17, near which a fuel injection device 30 of the illustrated embodiment is arranged. The fuel injection device 30 is connected to a fuel tank 20 through a filter 22, so that fuel discharged from the fuel tank 20 may be fed through the filter 22 to the fuel injection device 30.

The fuel injection device 30 of the illustrated embodiment, as detailedly described hereinafter, is constructed so as to prevent backflow of fuel, unlike the conventional fuel injection device. Thus, the fuel injection device 30 may be mounted directly on a wall of a cylinder of the engine, to thereby directly inject fuel into the cylinder.

The fuel injection device 30 is connected through a check valve 25 and a regulator 26 to an interior of the crank case 2, so that of a pneumatic pressure generated in the crank case 2 with driving of the engine 1, a positive pneumatic pressure is applied to the fuel injection device 30. The pneumatic pressure is also applied to the fuel tank 20 to pressurize fuel in the fuel tank 20. The pneumatic pressure is in a range which causes the positive pressure in the crank case 2 to be generally between 20 kPa and 100 kPa. However, it is applied through the regulator 26, so that a variation in pneumatic pressure may be minimized. Alternatively, air pressurized may be fed from the pressurizing means 9 to the fuel injection device 30 and fuel tank 20 in place of the pneumatic pressure generated in the crank case 2.

Now, the fuel injection device 30 will be described with reference to FIG. 2. The fuel injection device 30 includes a housing 31 formed into a substantially cylindrical shape. The housing 31 is provided therein with a solenoid coil 32, which is fed with electricity through a feed line 33, which is outwardly led out of the housing 31 through a guide hole formed through a wall of the housing 31. The solenoid coil 32 has a core 34 inserted thereinto, which has an air holding space 35 defined therein, which is open to one end surface of the core 34. The air holding space 35 is arranged so as to communicate on an open side thereof with an inlet passage 36. The air holding space 35 is formed at the other end thereof with a passage hole 38 through a tapered seat surface 37. The passage hole 38 is formed so as to be open to the other end surface of the core 34. The air holding space 35 is provided therein with an air control valve 39. The air control valve 39 includes a valve body 40 of a spherical shape pressedly contacted with the tapered seat surface 37 to close the passage hole 38, as well as a spring 41 for urging the valve body 40 to press the valve body against the seat surface 37. A pneumatic pressure generated in the crank case 2 is applied through the inlet passage 36 to the air holding space 35. The air holding space 35 is kept at a pressure of a predetermined level while the air control valve 39 keeps communication between the air holding space 35 and the passage hole 38 interrupted.

The housing 31 is provided on a distal end thereof with a valve casing 42. The valve casing 42 is formed on a distal end surface thereof with a fuel injection port or passage 43. The fuel injection port or passage 43 is arranged so as to communicate through a tapered seat surface 44 with an enlarged injection section 45 of an increased inner diameter. The injection section 45 has an injection nozzle 46 connected thereto. Between the injection nozzle 46 and the seat surface 44 is arranged a check valve 47 acting as a backflow preventing means for preventing backflow of fuel from the engine to the fuel injection device 30. The check valve 47 includes a valve body 48 of a spherical shape and a spring 49 for urging the valve body 48 to press it against the seat surface 44.

The valve casing 42 is provided therein with a valve body 50 of a disc-like shape adjacent to the other end of the core 34 in a manner to be movable. The valve body 50 includes a plunger 51 inserted at a half thereof into the solenoid coil 32 and a plunger 52 of a disc-like shape securely mounted on a front surface of the plunger 51. The diaphragm 52 has an outer periphery fixed on an inner peripheral surface of the housing 31 and is provided at a central portion thereof with an annular projection 53. The annular projection 53 is arranged so as to be abuttable against an inner surface of the valve casing 42 surrounding the fuel injection port or passage 43. The valve body 50 is forced toward the fuel injection passage 43 by a leaf spring 54 acting as an urging means. The leaf spring 54 urges the valve body 50 to intimately contact the annular projection 53 with the inner surface of the valve casing 42 surrounding the fuel injection port or passage 43, to thereby close the fuel injection passage 43.

The valve casing 42 is provided on a side peripheral surface thereof with a fuel feed passage 55 communicating with an exterior of the valve casing 42. The fuel feed passage 55 is connected to a fuel feed line 18 led out of the fuel tank 20, so that fuel is guided to a fuel holding space 56 defined in the valve casing 42 and housing 31. The fuel feed passage 55 is provided therein with a check valve 57, which functions to prevent backflow of fuel in the fuel holding space 56 to an exterior of the fuel injection device 30. The check valve 57 includes a spherical valve body 58 and a spring 59 acting as an urging means.

The valve body 50 has an air pipe 60 fixedly inserted therethrough so as to extend along a central axis thereof. The air pipe 60 is inserted at a rear end portion thereof into the passage hole 38 of the core 34 and at a front end portion thereof into the fuel injection passage 43. When the valve body 50 keeps closing the fuel injection passage 43, the air pipe 60 is kept from interfering with the valve body 40 of the air control valve 39, resulting in the air holding space 35 being kept closed. Also, when the valve body 50 is moved in a direction toward the core 34 to render the fuel injection passage 43 open, the air pipe 60 moves the valve body 40 of the air control valve 39 in a direction away from the seat surface 37, resulting in the air holding space 35 being open.

Now, the manner of operation of the fuel injection device of the illustrated embodiment thus constructed will be described hereinafter with reference to FIGS. 1 to 3.

As shown in FIG. 3, the model engine 1 is of the fourcycle type and adapted to repeat an intake stroke, a compression stroke, an expansion stroke and an exhaust stroke to continue driving thereof. Reciprocation of a piston P during driving of the engine 1 causes air in the crank case 2 to be varied in pressure. During ascending of the piston P in the exhaust stroke, a pressure in the crank case 2 is reduced. When the piston P descends during the intake stroke, the pressure is increased. When the piston P ascends in the compression stroke, the pressure is reduced. When the piston P descends in the expansion stroke, the pressure is increased. Repeating of such strokes permits a pulsating pressure (pneumatic pressure) to be generated in the crank case 2 depending on movement of the piston P. The pressure is so defined that positive and negative pressures thereof have a peak value of about 20 kPa to 100 kPa and a peak value of −20 kPa to −100 kPa on the basis of an average pressure in the crank case 2. respectively.

Of the pulsating pneumatic pressure generated from the crank case 2, only the positive pressure is extracted by the check valve 25 and then subject to processing by the regulator 26, resulting in a variation in positive pressure being minimized. The positive pneumatic pressure of which a variation is thus minimized is applied to the fuel injection device 30 and then kept pressurized in the air holding space 35. Whereas, fuel pressurized in the fuel tank 20 is fed through the check valve 57 from the fuel feed passage 55 to the fuel holding space 56. A part of the fuel which reaches a pressure sufficient to open the check valve 57 is taken out through the check valve 57, so that the fuel is kept at a predetermined or constant pressure in the fuel holding space 56 without backflow.

In the fuel injection device 30 constructed as described above, when the solenoid coil 32 is not energized, the valve body 50 is urged toward the fuel injection port or passage 43 by the leaf spring 54, so that the annular projection 53 of the diaphragm 52 arranged on the valve body 50 seals the fuel injection passage 43, resulting in fuel being kept from being injected. At this time, the air control valve 39 interrupts communication between the air holding space 35 and the passage hole 38, to thereby prevent air in the air holding space 35 from entering the air pipe 60.

The fuel injection device 30, as shown in FIG. 3, is driven at a predetermined timing with respect to each of the strokes of the engine 1, to thereby inject fuel thereto. Such driving of the fuel injection device 30 is controlled by the control section 4. A timing of fuel injection is determined by the rotational positional sensor 12 for detecting a position of the crank 11. When the rotational position sensor 12 detects a position of the crank 11 to detect initiation of opening of the intake valve 17, the control section 4 is fed with a detection signal from the sensor 12, resulting in energizing the solenoid coil 32 of the fuel injection device 30 as shown in FIG. 3, so that fuel injection may be started. Also, the engine carries out rotation two times at every stroke because it is the four-cycle type, so that detection of the injection timing may be carried out by means of a poppet cam shaft (not shown). The amount of fuel injected or a fuel injection rate may be suitably set depending on a degree of opening of the throttle valve 14, a signal outputted from the intake air quantity/temperature sensor 16 arranged at the air intake port of the intake manifold 13, and the like.

When the solenoid coil 32 is energized, it magnetically attracts the valve body 50 to the core 34 against elastic force of the leaf spring 54, to thereby magnetically bond the former to the latter. This causes a gap to occur between the annular projection 53 of the valve body 50 and the inner surface of the valve 42. Fuel in the fuel holding space 56 is permitted to enter the fuel injection passage or port 43 to open the check valve 47. At this time, when the valve body 50 is moved toward the core 34, the air pipe 60 arranged integrally with the valve body 50 is moved in the same direction as the valve body 50 to forcibly separate the valve body 40wof the air control valve 39 from the seat surface 37. Thus, the air control valve 39 is rendered open. This permits air in the air holding space 35 to be injected from the fuel injection port or passage 43 through the air pipe 60 toward the injection nozzle 46. This results in the fuel injected from the fuel injection passage 43 being fully mixed with air ejected from the air pipe 60 and then injected in a fine mist-like manner from the injection nozzle 46 toward a front region of an exterior of the valve casing 42.

Now, the manner of operation of the model engine 1 will be described hereinafter with reference to FIG. 3.

In general, in a four-cycle engine intake such as the model engine 1, compression, explosion and exhaust strokes take place independently from each other. Thus, the fuel injection device 30 is actuated either during the intake stroke or immediately before the intake stroke in view of a delay in operation. Fuel injected from the fuel injection device 30 in the intake manifold 13 is mixed with air sucked depending on a degree of opening of the throttle valve 14 to prepare an air-fuel mixture when the intake valve 17 is open with progress of the intake stroke to cause the piston P to initiate movement in a direction of a bottom dead center, so that the mixture enters the cylinder from the intake valve 17. Then, the intake valve 17 is closed to cause movement of the piston P from the bottom dead center to a top dead center to be started, followed by transfer to the compression stroke. The air-fuel mixture is ignited by heat of the glow plug 19 near the top dead center, to thereby be exploded or expanded. Force by the explosion or expansion causes the piston P to start movement in the direction of the bottom dead center. Thereafter, the exhaust valve 23 is rendered open, resulting in combustion gas being outwardly exhausted from the cylinder with ascending of the piston P.

The fuel injection device 30 of the illustrated embodiment, as described above, is so constructed that the fuel injection port or passage 43 is provided with the check valve 47. Such construction effectively prevents backflow of fuel to the fuel injection device 30 even when a pressure on a side of the engine 1 into which fuel is injected is increased. This permits the fuel injection device 30 to be mounted on the cylinder to inject fuel directly into the combustion chamber, as indicated at phantom lines in FIG. 1.

Also, the illustrated embodiment may be constructed in such a manner that pressurized air is excessively fed to the engine during fuel injection, to thereby fully mix fuel with the air and a fuel injection rate is increased to inject fuel in an extremely fine mist-like manner. This permits the model engine exposed to severe operational conditions or environment to be improved in ignition efficiency and increased in output thereof, and ensures stable feeding of fuel to the engine, so that an air-fuel ratio may be effectively balanced to a degree sufficient to permit the engine to exhibit stable increased performance.

In the illustrated embodiment, fuel is pressurized to a constant level by a pneumatic pressure in the crank case, to thereby stabilize injection of fuel. Also, fuel injected is mixed with pressurized air injected from the air pipe 60 only during fuel injection, to thereby prepare a fine mist-like air-fuel mixture, so that the mixture may be effectively fed to the combustion chamber while being prevented from adhering to the intake manifold 13 and intake valve 17, resulting in combustion efficiency being increased. In addition, the air pipe 60 also functions to outwardly escape air in the crank case 2 closed, to thereby reduce resistance during actuation of the piston P, resulting in engine efficiency being further enhanced.

In general, a radio-controlled model airplane on which a model engine having a fuel injection device incorporated therein is mounted is often subject to an acrobatic flight such as looping or the like. Such severe flight conditions tend to render fuel injection by the fuel injection device unstable. More particularly, fuel in a fuel tank and that in a fuel feed pipe for connecting the fuel tank and fuel injection device to each other are exposed to gravity and centrifugal force depending on hard operation of the model airplane while being continuously varied in magnitude and direction of the gravity and force. Thus, it is substantially difficult to keep fuel injection of the fuel injection device constant, so that feeding of fuel from the fuel injection device to the engine is rendered unstable.

The fuel injection device 30 of the illustrated embodiment effectively solves such problems. More particularly, fuel filled in the fuel injection device 30 is confined in the device by the check valve 57, to thereby satisfactorily prevent backflow of fuel from the fuel injection device 30 to an exterior thereof even when a pressure of fuel fed to the fuel injection device 30 is varied due to such external factors as described above.

The fuel injection device 30 is generally actuated during the intake stroke although it is often actuated immediately before the intake stroke in view of the operation time. The engine 1 is of the four-cycle type, so that during the intake stroke, a pressure in the cylinder is reduced, whereas a pressure in the crank case 2 is increased. Thus, feeding of air to the air holding space 35 is carried out when a pressure in the crank case 2 is increased as compared with that in the cylinder and pressurized air in the air holding space 35 is injected in synchronism with injection of fuel, so that fuel may be efficiently injected in the form of fine mist into the cylinder. This ensures stable feeding of fuel from the fuel injection device 30 to the engine and an improvement in output of the engine even under severe operational conditions, to thereby prevent an engine failure due to deficiency or excess of fuel.

Figure 4:
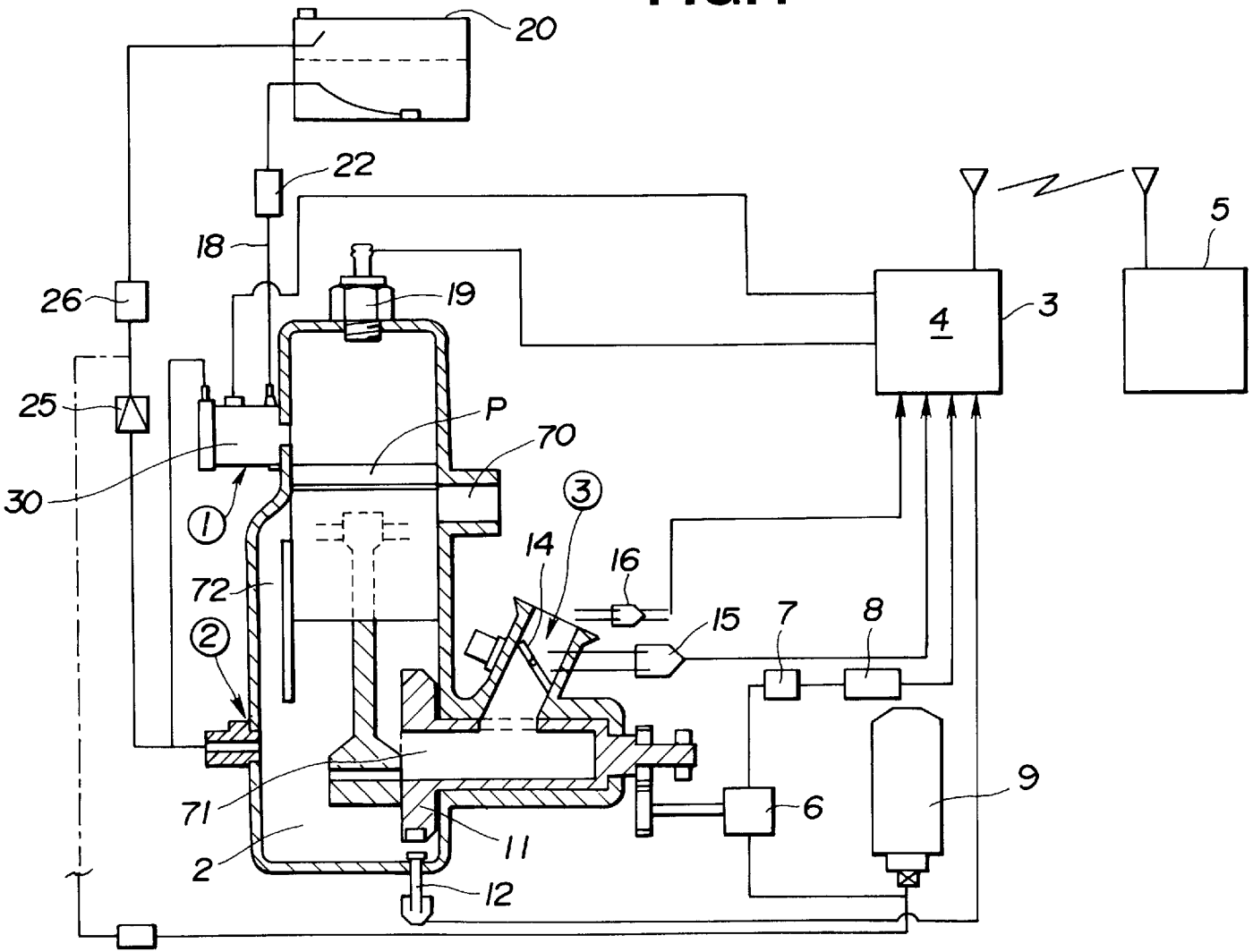
FIG. 4 is a schematic view showing an example of a model engine to which another embodiment of a fuel injection device according to the present invention may be applied.
Figure 5:
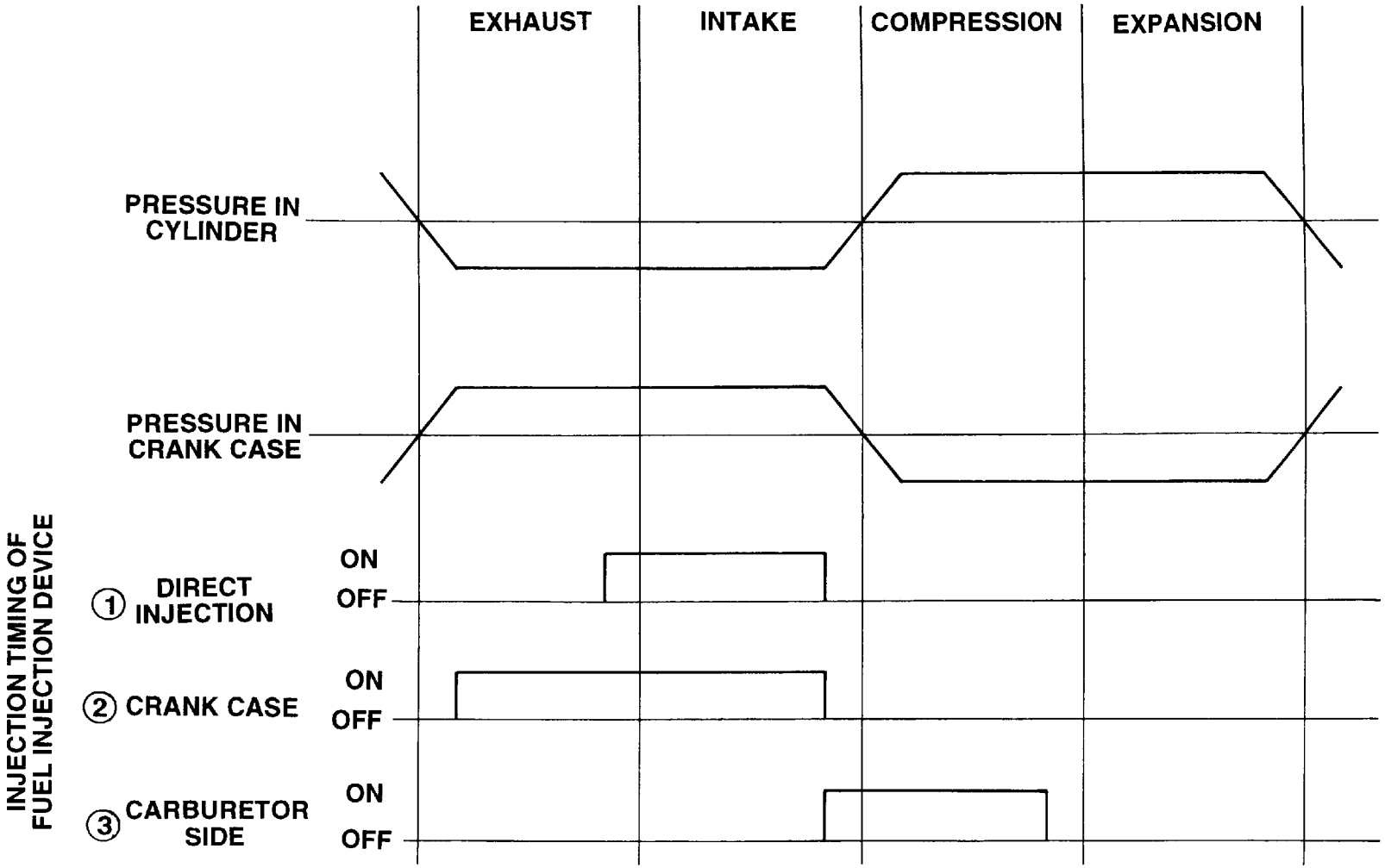
FIG. 5 is a timing chart showing a timing of actuation of a model engine having a second embodiment of a fuel injection device according to the present invention incorporated therein, that of a variation in pressure in a cylinder, that of a variation in pressure in a crank case, and that of the fuel injection device of the second embodiment.
Figure 6:
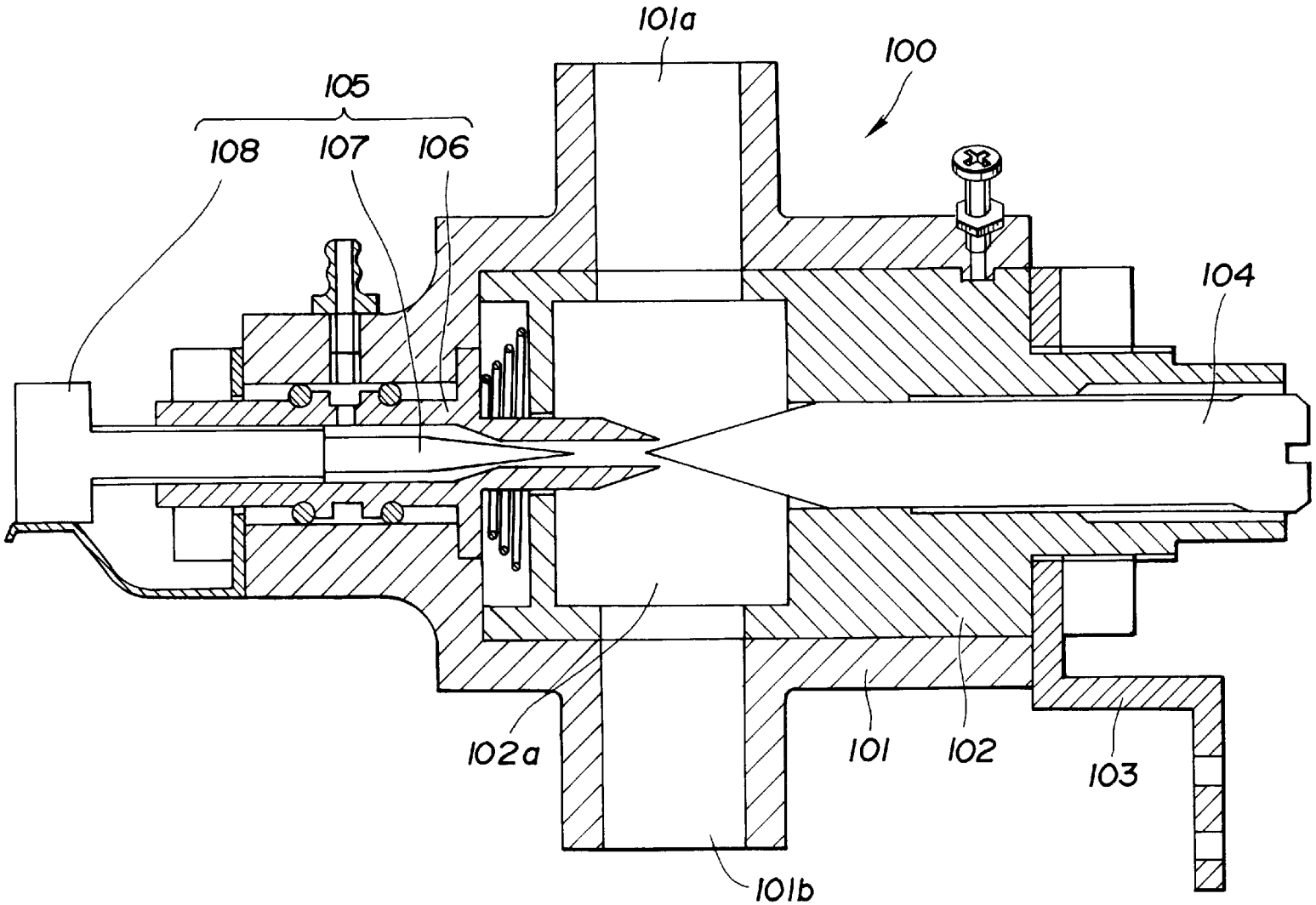
FIG. 6 is a sectional view showing a conventional carburetor.

Referring now to FIGS. 4 and 5, a second embodiment of a fuel injection device for a model engine according to the present invention is illustrated. A fuel injection device of the second embodiment generally designated at reference numeral 30 is adapted to be applied to an electronically controlled two-cycle model engine. A two-cycle engine lacks an intake valve and an exhaust valve unlike a four-cycle engine and includes a cylinder directly formed with an exhaust port 70, an intake port 71 and a scavenging port 72, which are operated by a piston P. In FIG. 4, reference numerals like those in FIG. 1 designate corresponding parts. The fuel injection device 30 of the illustrated embodiment may be selectively arranged at any one of positions indicated at ① to ③ in FIG. 4.

① indicates a position which permits fuel to be injected directly into a combustion chamber of the cylinder. The prior art fails to mount the fuel injection device at the position ①. The fuel injection device 30 of the illustrated embodiment includes a check valve 47, which prevents backflow of an air-fuel mixture in the cylinder to the fuel injection device 30 during the compression and expansion strokes, to thereby keep a suitable compression ratio. ② indicates a position which permits fuel to be injected into a crank case 2 and ③ is a position which permits fuel to be injected from a side of a carburetor or a side of a throttle valve 14.

Now, operation of the engine in the case of position ① will be described with reference to FIG. 5 by way of example. When the piston P is descended due to expansion of combustion gas, the exhaust port 70 is first open to start exhaust of the combustion gas. Then, the scavenging port 72 is open, resulting in a pressure in the cylinder being reduced and a pressure in the crank case 2 being increased. This causes air in the crank case 2 to be flowed through the scavenging port 72 into the cylinder, so that combustion gas in the cylinder is forcedly discharged from the exhaust port 70. Then, when the piston P is ascended, a negative pressure is produced in the crank case 2, so that flowing of air from the intake port 71 into the crank case 2 is started. The fuel injection device 30 is actuated at the end of the exhaust stroke to inject fuel into the cylinder until start of the compression. Then, when the piston P approaches to the top dead center, it closes the exhaust port 70 and scavenging port 72 to render the cylinder airtight, leading to compression of an air-fuel mixture or mixed gas in the cylinder. When the piston P reaches the top dead center, a glow plug 19 ignites the mixed gas to start the combustion. This causes descending of the piston P to be started, followed by transfer to the exhaust stroke.

In the position ② wherein the fuel injection device 30 is mounted in the crank case 2, as shown in FIG. 5, the fuel injection device 30 is actuated between the exhaust stroke in which the piston P is descended and the intake stroke wherein the piston P has turned off to ascending, to thereby inject atomized fuel into the crank case 2.

In the position ③ wherein the fuel injection device 30 is mounted on the side of the throttle valve 14, the fuel injection device 30 is actuated at the end of the intake stroke, to thereby inject atomized fuel into the crank case 2 during the compression stroke.

The fuel injection device 30 of each of the embodiments described above is adapted to be arranged in the model engine mounted on the radio-controlled model airplane. Such models include in addition to a radio-controlled model airplane for a hobby, any mobile commonly utilized in an industrial field which has a relative small engine mounted thereon, such as a model car, a model ship and the like.

A two-cycle engine is different from a four-cycle engine in that the latter is constructed so as to permit positive and negative pressures generated in a crank case to be substantially equal in absolute value to each other. More particularly, the two-cycle engine causes air to be flowed from an intake port into a crank case during the compression stroke, so that an absolute value of a peak of a negative pressure generated in the crank case during the compression stroke is smaller than that of a positive pressure generated in the crank case during the expansion stroke.

As can be seen from the foregoing, the fuel injection device of the present invention is so constructed that the check valve is arranged in the fuel injection passage or port to prevent backflow of fuel. Such construction permits the fuel injection device to be mounted directly on the cylinder to inject fuel directly into the combustion chamber, unlike the prior art. Also, in the present invention, pressurized air held in the air holding means may be injected together with fuel only during fuel injection, resulting in fuel being injected in the form of a fine mist-like shape.

Thus, the present invention permits an air-fuel ratio to be controlled to ensure stable driving of the engine. Also, it permits air and fuel to be mixed together in the fuel injection device to prepare an air-fuel mixture, followed by injection of the mixture, to thereby enhance both combustion efficiency and output of the engine. Further, the present invention ensures feeding of a constant excess of air to the engine, leading to a further increase in output of the engine.

While preferred embodiments of the invention have been described with reference to the drawings, obvious modifications and variations are possible in light of the above teachings. It is therefore to be understood that within the scope of the appended claims, the invention may be practiced otherwise than as specifically described.

What is claimed is:

1. A fuel injection device for a model engine, comprising:

a housing;

a fuel holding space defined in said housing;

a fuel feed passage through which fuel is fed to said fuel holding space;

a fuel injection port which is provided at said housing so as to communicate with said fuel holding space and through which fuel is injected into a combustion chamber of the model engine;

a solenoid coil arranged in said housing;

a core arranged in said solenoid coil;

a valve body arranged in said housing, said valve body having a plunger inserted into said solenoid coil and a diaphragm mounted on the front of said plunger, said diaphragm provided with an annular projection extending to said fuel injection port and surrounding said fuel injection port fuel injection port to normally close said fuel injection port, said valve body being magnetically attracted to said core due to energizing of said solenoid coil to open said fuel injection port;

an urging means for urging said valve body in a direction of closing of said fuel injection port; and a check valve arranged at said fuel injection port to prevent backflow of fuel from said fuel injection port to an interior of said housing.

2. A fuel injection device as defined in claim 1, further comprising:

an air holding space defined in said housing to hold therein pressurized air fed from an exterior of said housing;

an air pipe fixed on said valve body to permit said air holding space and fuel injection port to communicate with each other; and an air control valve arranged so as to interrupt communication between said air holding space and said air pipe while said valve body keeps said fuel injection port closed and maintain said communication while said valve body keeps said fuel injection port open.

3. A fuel injection device for a model engine, comprising:

a housing;

a fuel holding space defined in said housing;

a fuel feed passage through which fuel is fed to said fuel holding space;

a fuel injection port which is provided at said housing so as to communicate with said fuel holding space and through which fuel is injected into a combustion chamber of the model engine;

a valve body arranged in said housing between said fuel holding space and said fuel injection port, said valve body having a diaphragm provided with an annular projection extending to said fuel injection port and surrounding said fuel injection port to normally close fluid communication from said fuel holding space to said fuel injection port; and a check valve positioned in said fuel feed passage so as to prevent backflow of fuel from the fuel holding space to a location exterior of said fuel injection port.

* * * * *